US008002914B1

(12) United States Patent
D'Arche et al.

(10) Patent No.: US 8,002,914 B1
(45) Date of Patent: Aug. 23, 2011

(54) SMOKELESS FLASH POWDER

(75) Inventors: Steven P. D'Arche, Odon, IN (US); Travis Swanson, Bloomfield, IN (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 72 days.

(21) Appl. No.: 12/409,956

(22) Filed: Mar. 24, 2009

Related U.S. Application Data

(62) Division of application No. 11/144,850, filed on Jun. 6, 2005.

(51) Int. Cl.

| | |
|---|---|
| ***C06B 33/00*** | (2006.01) |
| ***C06B 33/04*** | (2006.01) |
| ***C06B 31/00*** | (2006.01) |
| ***C06B 27/00*** | (2006.01) |
| ***D03D 23/00*** | (2006.01) |
| ***D03D 43/00*** | (2006.01) |

(52) U.S. Cl. ..... 149/37; 149/43; 149/45; 149/87; 149/108.2; 149/109.2; 149/109.4; 149/109.6

(58) Field of Classification Search ..... 149/37, 149/43, 45, 87, 108.2, 109.4, 109.6
See application file for complete search history.

(56) References Cited

U.S. PATENT DOCUMENTS

| | | | | |
|---|---|---|---|---|
| 4,976,201 | A | 12/1990 | Hamilton | |
| 5,587,552 | A | 12/1996 | Dillehay et al. | |
| 5,725,699 | A * | 3/1998 | Hinshaw et al. | 149/19.1 |
| 5,962,808 | A * | 10/1999 | Lundstrom | 149/19.1 |
| 6,235,132 | B1 | 5/2001 | Knowlton et al. | |
| 6,470,806 | B1 * | 10/2002 | Murray | 102/498 |
| 6,605,167 | B1 * | 8/2003 | Blomquist | 149/7 |
| 6,969,435 | B1 * | 11/2005 | Hinshaw et al. | 149/45 |
| 2004/0256038 | A1 * | 12/2004 | Wood et al. | 149/19.3 |

* cited by examiner

*Primary Examiner* — James E McDonough
(74) *Attorney, Agent, or Firm* — Christopher A. Monsey

(57) ABSTRACT

A flash powder formulation for use in flash grenades that produces reduced smoke containing from about 10 percent by weight to about 60 percent by weight of zirconium hydride, from about 40 percent by weight to about 90 percent by weight CAN, and from zero percent by weight to about 5 percent by weight of a binder material.

5 Claims, No Drawings

SMOKELESS FLASH POWDER

This application is a divisional of U.S. patent application Ser. No. 11/144,850, filed Jun. 6, 2005, the disclosures of which are expressly incorporated by reference herein.

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

This invention relates in general to flash powder formulations, more particularly to smokeless flash powder formulations, and most particularly to smokeless flash powder formulations that provide adequate report and light emissions.

2. Description of the Related Art

Many law enforcement and military personnel employ flash grenades as one method of entering an area containing hostile targets. The flash grenades provide sound and light in order to blind and deafen hostile targets in order to subdue the targets as safely as possible.

The flash powder normally used in creating the light and sound normally contains potassium perchlorate and aluminum powder. While this mixture produces effective light and sound report, it also produces a significant amount of smoke through the formation of potassium chloride and aluminum oxide. This obscurant smoke has the effect of blinding the law enforcement or military personnel as well as hostile targets.

Therefore, it is desired to provide a flash powder for use in flash grenades that produces an adequate light and report emission as well as reduces smoke produced by the powder.

SUMMARY OF THE INVENTION

The invention proposed herein comprises an improved flash powder formulation that can be employed in flash grenades. The formulation provides adequate report and light emissions without producing significant obscurant smoke that may interfere with a flash grenade's intended use.

Accordingly, it is an object of this invention to provide a flash powder that produces adequate report and light emissions upon ignition.

It is a further object of this invention to provide a flash powder that produces minimal smoke upon ignition.

This invention meets these and other objectives related to improved flash powder formulations by providing a flash powder that can be employed in a flash grenade comprising in general from about 10 percent by weight to about 60 percent by weight of zirconium hydride, from about 40 percent by weight to about 90 percent by weight ceric ammonium nitrate ("CAN"), and from zero to about 5 percent by weight of a binder material. In a preferred embodiment, the formulation comprises from about 38 percent by weight to about 44 percent by weight zirconium hydride and about 52 percent by weight to about 58 percent by weight CAN. The invention also includes a method of using the flash powder formulation in a flash grenade in order to blind a target.

DESCRIPTION OF PREFERRED EMBODIMENTS

The invention, as embodied herein, comprises a flash powder formulation that produces minimal smoke upon ignition.

Therefore, the flash powder of the present invention may be employed in flash grenades to produce a high report to deafen targets and light emissions to blind targets without producing smoke that could interfere with law enforcement or military personnel locating the blinded/deafened targets.

Present flash grenade powders produce smoke obscurant because the reaction of the potassium perchlorate and aluminum powder ingredients produce potassium chloride and aluminum oxide particles. Therefore, the inventors have determined that to reduce or remove the smoke obscurant, ingredients should be selected to minimize production of solid particles, while maintaining adequate report and light emissions.

CAN is an oxidizer that contains a high percentage of nitrogen and hydrogen ($Ce(NO_3)_6(NH_4)_2$) that allows for a decrease in the percentage of post-blast particulate matter in a flash powder formulation compared to a formulation containing potassium perchlorate and aluminum powder. Also, the excess nitrogen and hydrogen as well as the reactivity of CAN contributes to an excellent report in a flash powder formulation.

Previous flash powder formulations have employed aluminum, magnesium, titanium, and zirconium metals as fuels to produce "white light" for the blinding affect of flash grenades. However, using these fuels in a "smokeless" flash powder, particularly in combination with CAN, is problematic. First, the metals have an extremely high reactivity with CAN, creating handling and other safety issues. Second, using a metallic fuel to react with CAN produces a metallic oxide, which creates solid particles that make up smoke obscurant. As a result, zirconium hydride was selected as the preferred fuel of the present invention because it is less dangerous to handle than metallic powders and reacts with the oxygen in CAN to produce H2O to remove some of the oxygen that can react with the zirconium to produce zirconium oxide; thereby, significantly reducing the metallic oxide produced by the improved formulation. In addition, the hydride also aids in the production of gaseous products in the reaction.

Therefore, in general, the invention is an improved flash powder formulation that comprises from about 10 percent by weight to about 60 percent by weight of zirconium hydride, from about 40 percent by weight to about 90 percent by weight CAN, and from zero to about 5 percent by weight of a binder material.

Preferably, the formulation comprises from about 38 percent by weight to about 44 percent by weight zirconium hydride, from about 52 percent by weight to about 58 percent by weight CAN, and about 3 percent of a binder material. These preferred ranges provide for an oxygen balanced formula for the formulation.

In the most preferred oxygen balanced formulation of the present invention, the formulation contains 56.8 percent by weight CAN and 43.2 percent by weight zirconium hydride, not including the binder. With the binder included, these percentages are slightly reduced.

The zirconium hydride used in the present invention is in powder format, preferably with a diameter in the 1 to 50 micron size, most preferably about 5 microns. The CAN powder will normally be in the 20 to 70 micron diameter size, with an exemplary size being about 325 mesh (or about 40-50 microns). The binder material may be any binder known in the art that is compatible with the other ingredients of the formulation and does not form particles due to a reaction with the other ingredients. Preferred binder materials include nitrocellulose, Viton®, Hytemp®, and poly vinyl alcohol.

A theoretical example of how to make the formulation of the present invention follows. First, both CAN and zirconium hydride powders are dried in an oven for about 12 hours. The zirconium hydride is added to a solution of the binder material and the two are thoroughly mixed in order to ensure that the zirconium hydride is sufficiently coated with the binder material. The CAN is thoroughly mixed into the zirconium hydride/binder material mixture and the solvent is allowed to evaporate until the mixture is optimized for granulation. The mixture is then granulated by pushing it through a screen. Finally, the granules are dried in an oven for about 12 hours.

The invention also includes use of the flash powder formulation described herein in a flash grenade in order to blind/deafen a target without creating smoke obscurant. In general, the flash powder is ignited so that the target can see the resulting flash, thereby neutralizing the target. Preferably, the flash powder is placed within a grenade shell and thrown at the target.

What is described are specific examples of many possible variations on the same invention and are not intended in a limiting sense. The claimed invention can be practiced using other variations not specifically described above.

What is claimed is:

1. A method of blinding a target, comprising the steps of:

providing a flash powder comprising from about 10 percent by weight to about 60 percent by weight of zirconium hydride, from about 40 percent by weight to about 90 percent by weight CAN; and from about zero percent by weight to about 5 percent by weight of a binder material; and, igniting the flash powder wherein reaction products of the flash powder are seen by the target.

2. A method of blinding a target, comprising the steps of:

providing a flash powder comprising about 38 percent by weight to about 44 percent by weight zirconium hydride, about 40 percent by weight to about 90 percent by weight CAN, and about zero percent by weight to about 5 percent by weight of a binder material; and igniting the flash powder, wherein reaction products of the flash powder are seen by the target.

3. The method of claim 2, wherein the flash powder comprises about 52 percent by weight to about 58 percent by weight CAN.

4. The method of claim 3, further comprising the steps of:

placing the flash powder in a grenade shell; and, throwing the grenade shell toward the target after the ignition step.

5. A method of blinding a target, comprising the steps of:

providing a flash powder comprising about 25 percent by weight to about 60 percent by weight zirconium hydride, about 40 percent by weight to about 75 percent by weight CAN, and about zero percent by weight to about 5 percent by weight of a binder material; and igniting the flash powder, wherein reaction products of the flash powder are seen by the target.

* * * * *